US005470272A

United States Patent [19]

Kikuchi et al.

[11] Patent Number: 5,470,272

[45] Date of Patent: Nov. 28, 1995

[54] REMOVABLE WORKING TOOL ASSEMBLY

[75] Inventors: Naoki Kikuchi, Chandler, Ariz.; Nobuto Kai, Fuchu, Japan

[73] Assignee: Ryobi Motor Products Corp., Easley, S.C.

[21] Appl. No.: 191,515

[22] Filed: Feb. 3, 1994

[51] Int. Cl.[6] ..... B24B 23/00

[52] U.S. Cl. ..... 451/344; 451/356

[58] Field of Search ..... 451/356, 354, 451/357, 344, 456, 502, 512, 540, 557

[56] References Cited

U.S. PATENT DOCUMENTS

| | | | |
|---|---|---|---|
| 1,501,192 | 6/1924 | Severns . | |
| 1,840,254 | 1/1932 | Richardson . | |
| 2,350,098 | 12/1941 | Decker . | |
| 2,689,436 | 9/1954 | Wagner . | |
| 2,734,139 | 2/1956 | Murphy . | |
| 2,836,940 | 6/1958 | Carmichael . | |
| 2,954,653 | 8/1960 | Harvey | 451/56 |
| 3,160,995 | 12/1964 | Danuski, Jr. . | |
| 3,190,045 | 6/1965 | Zuzelo . | |
| 3,443,271 | 5/1969 | Lyons . | |
| 3,474,512 | 8/1969 | Hansen | 451/356 |
| 3,619,954 | 11/1971 | Miller . | |
| 3,892,091 | 7/1975 | Hutchins . | |
| 3,967,417 | 7/1976 | Jurak | 451/356 |
| 4,380,092 | 4/1983 | Brothers . | |
| 4,640,006 | 2/1987 | Lukianoff . | |
| 4,686,797 | 8/1987 | Hoffman . | |
| 4,825,597 | 5/1989 | Matechuk . | |
| 4,905,420 | 3/1990 | Flachenecker et al. . | |
| 4,920,702 | 5/1990 | Kloss et al. . | |
| 5,123,216 | 6/1992 | Kloss et al. . | |

FOREIGN PATENT DOCUMENTS

| | | |
|---|---|---|
| 737766 | 5/1932 | France . |
| 2365411 | 4/1978 | France . |
| 2420276 | 10/1979 | France . |
| 2262865 | 7/1973 | Germany . |
| 2741255 | 3/1979 | Germany . |
| 2742062 | 4/1981 | Germany . |
| 3012836 | 10/1981 | Germany . |
| 2426106 | 9/1984 | Germany . |
| 3540561 | 11/1985 | Germany . |
| 56-3174A | 1/1981 | Japan . |
| 2141620 | 1/1985 | United Kingdom . |

*Primary Examiner*—Bruce M. Kisliuk
*Assistant Examiner*—Derris Banks
*Attorney, Agent, or Firm*—Brooks & Kushman

[57] ABSTRACT

A removable working tool assembly that can be used with a power driven tool having a drive shaft. The removable working tool assembly includes a drive member which can operably connected to the drive shaft and a support member having a tool surface. One of the drive and support members defines a male connection mechanism while the other one of the members defines a female connection mechanism such that the members can be simply connected and disconnected without the need for tools or any other fastener elements. This allows various support members to be easily changed to facilitate the use of different tool surfaces such as sanders, grinders, scrapers or the like.

23 Claims, 2 Drawing Sheets

REMOVABLE WORKING TOOL ASSEMBLY

TECHNICAL FIELD

This invention relates to a power driven tool, such as a finish sander or grinder. More particularly, this invention relates to a removable working tool assembly which can be connected to an oscillating tool and which allows a variety of working tools, such as sanders, grinders, scrapers or the like, to be easily interchanged.

BACKGROUND ART

Hand held power tools, such as finish sanders or grinders, are used for a variety of purposes. In the case of a finish sander for example, they can be used to perform specific finishing tasks such as sanding edges adjacent internal walls. To perform such tasks, finish sanders or grinders operate with controlled finite movements in a confined area so as to fine sand or grind a desired area without damaging the surrounding surfaces. Various approaches have been taken to perform the difficult task of sanding or grinding these internal corners and other hard to reach areas which require fine sanding or abrasion.

Initially, hand tools were utilized to perform these tasks. U.S. Pat. No. 4,825,597 to Mateschuk discloses such a corner hand sander. However, electrically operated tools have replaced such hand corner sanders. Such electrically driven sanders or grinders typically employ an abrasive pad which is driven in a pivotal or oscillating manner. In using such electrically driven sanders or grinders, it is desirable to be able to change the shape of the abrasive pad for different applications or to reach into different areas, such as tight crevices.

In some applications it is desirable to employ a dust collection system to collect dust resulting from the grinding or sanding process in order to minimize clean up and to prevent a build up of that dust from interfering with the grinding or sanding process.

It is especially desirable for an electrically driven sander or grinder to have removable and interchangeable pads, all of which will operate properly in conjunction with the dust collection features of such a tool. Various approaches have been taken in the past to solve these problems.

U.S. Pat. No. 4,920,702 to Kloss et al. discloses a portable grinder which relies upon pivotally oscillating a pad about a pivot axis which intersects a central region of the pad. The drive shaft of the grinding tool is externally or internally threaded and the pad is connected to the drive shaft via a nut or screw arranged in a central recess of the pad. The drive shaft also defines a central bore for the removal of dust by suction through the center of the sanding pad. Additionally, in order to ensure that dust is removed throughout the pad surface and not only centrally, grooved suction channels are provided in the working surface of the sanding pad itself.

An alternative approach is disclosed in U.S. Pat. No. 4,905,420 to Flachenecker et al. in which, similar to the portable grinder disclosed in Kloss et al., the grinding pad is held to the drive shaft by a clamping element, such as a bolt, arranged in a central recess of the pad. In order to remove dust resulting from grinding, an exhaust hood is provided which sealingly engages the upper surface of the sanding pad such that the seal is maintained while the pad is oscillated relative to the exhaust hood. Suction is applied to the exhaust hood via a suction hose. That suction collects any resulting grinding dust through openings which are provided through the pad itself.

The portable grinder arrangements disclosed in Kloss et al. and Flachenecker et al. leave several problems unsolved. First, the pads are not easily interchanged. In order to change a pad, the portable grinder must be turned upside down, the screw or nut unfastened, the pad replaced, and the screw or nut resecured. Second, by utilizing a central vacuum bore and a grooved pad as disclosed in Kloss et al., or suction openings through the pad itself as disclosed in Flachenecker et al., the effective area of the pad is greatly reduced. Furthermore, if working in a cramped space where little movement of the pad is possible, such discontinuities in the working surface of the pad will interfere with proper grinding or sanding, leaving impressions on the surface being worked between the abrasive pad surfaces and the non-abrasive discontinuities. Third, some by-product dust resulting from grinding or sanding operations is desirable between the pad and the working surface in order to provide extra abrasive material. Because the Kloss et al. and Flachenecker et al. inventions suck abrasive by-products through the pad surface itself, the by-products do not have a chance to assist the user.

Accordingly, there remains a need for a working pad tool which may be easily removed and interchanged with other tools and which, if desired, allows for the collection of dust or other debris around its periphery, and not through the working surface of the tool itself.

SUMMARY OF THE INVENTION

A removable working tool assembly is provided to be used in conjunction with a power tool, such as a finish sander or the like. The removable working tool assembly comprises a drive member which can be operably connected to a drive shaft of the power tool and a support member having a tool surface. One of the drive and support members defines a male connection mechanism while the other one of the drive and support members defines a female connection mechanism such that the male connection mechanism may operably engage the female connection mechanism without the need for tools or any other fastener elements. This allows a variety of support members to be easily disconnected or reconnected to the drive member.

In a preferred embodiment of this invention, the male connection mechanism comprises a grooved portion and the female connection mechanism comprises a slot having a tongue such that the grooved portion may be slid into operable engagement with the slot having a tongue.

In the event the invention is used with a power tool having a dust collection system, an alternative working tool assembly comprises a drive member which can be operably connected to a drive shaft of the power tool and which defines a drive member conduit communicating a drive member exit opening with a drive member collection opening. The drive member exit opening can be operably connected to the dust collection system. The working tool assembly of this embodiment also includes a support member having a tool surface and a periphery surface which defines dust intake openings. The support member also defines a support exit opening and support conduits connecting the dust intake openings to the support exit opening. One of the drive and support members defines a male connection mechanism while the other one of the drive and support members defines a female connection mechanism such that the male connection mechanism may operably engage the female connection mechanism without the need for tools or any other fastener elements. When the male connection mechanism is connected to the female connection mechanism, the support exit opening communicates with the drive member collection opening.

The advantages accruing to the present invention are numerous. For example, a support member having a tool surface with a particular geometrical configuration may be easily removed and interchanged with another support member having a tool surface with an alternative geometric configuration by simply disengaging the connection mechanisms.

Another advantage is that by locating the dust intake openings at the periphery surface of the support member, in lieu of through the tool surface of the support member, the amount of tool surface available for work purposes is maximized.

Yet another advantage of locating the dust intake openings at the periphery surface of the support member is that it allows a certain amount of dust resulting from processes such as sanding or grinding to collect underneath the tool surface and aid in abrading the surface being worked upon. To the extent it is desired to remove such dust, the support member need merely be moved so that such dust is exposed to the dust intake openings.

These objects, and other objects, features and advantages of the present invention will be readily appreciated by one of ordinary skill in the art from the following detailed description of the best mode for carrying out the invention when taken in connection with the accompanying drawings.

BEST MODE FOR CARRYING OUT THE INVENTION

The working tool of the present invention is intended to be used in conjunction with a sanding apparatus of the type shown in PCT/US93/07589 entitled "Detail Sander," which is incorporated by reference herein. The present invention can also be used in conjunction with tool assemblies for sanders of the type shown in U.S. Pat. No. 4,920,702 to Kloss et al.

Figure 1:
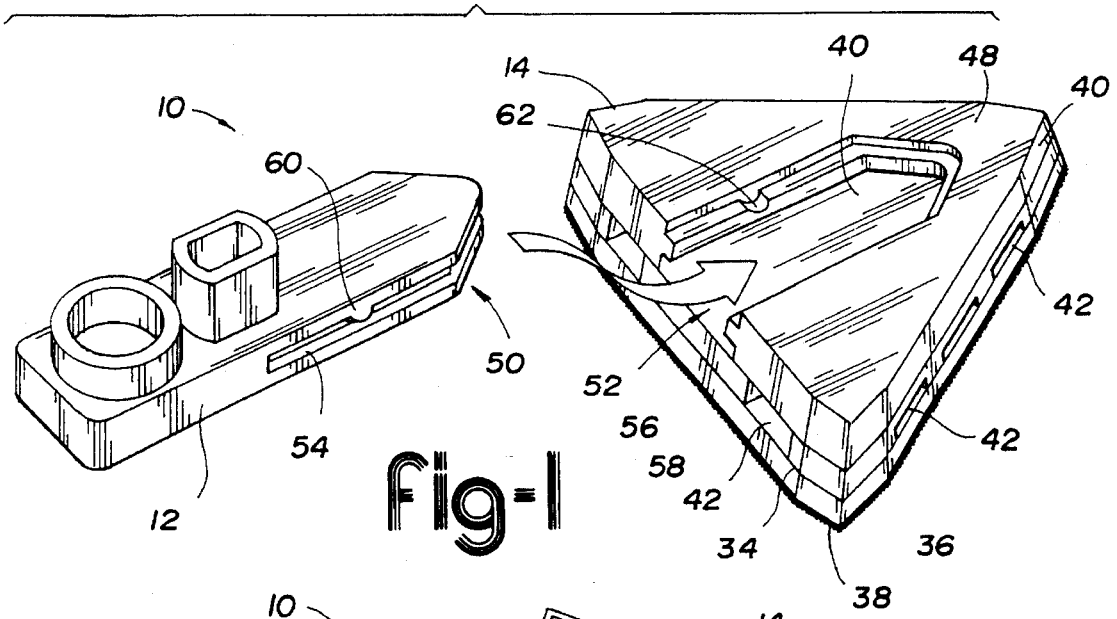
FIG. 1 is a perspective view of one embodiment of the improved removable working tool assembly showing how the drive member may be connected to the support member.
Figure 2:
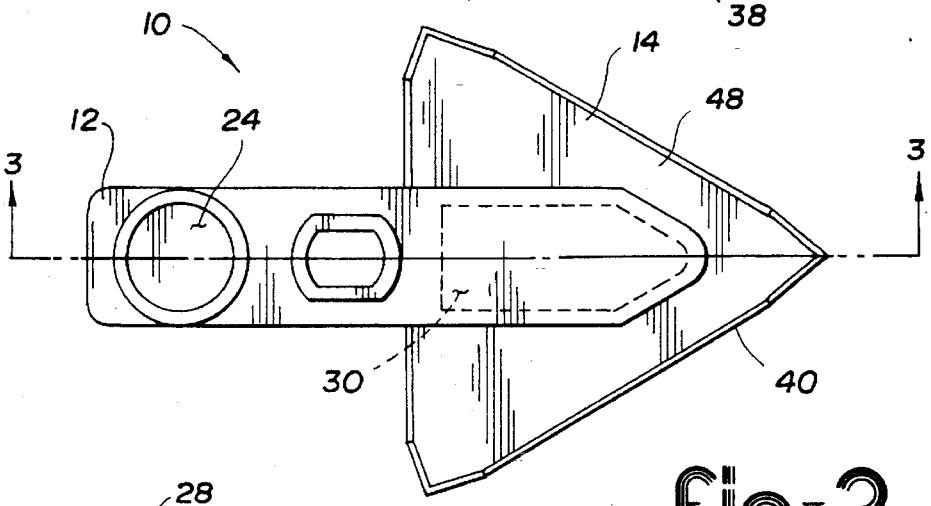
FIG. 2 is a top view of the removable working tool assembly with the drive member connected to the support member.
Figure 3:
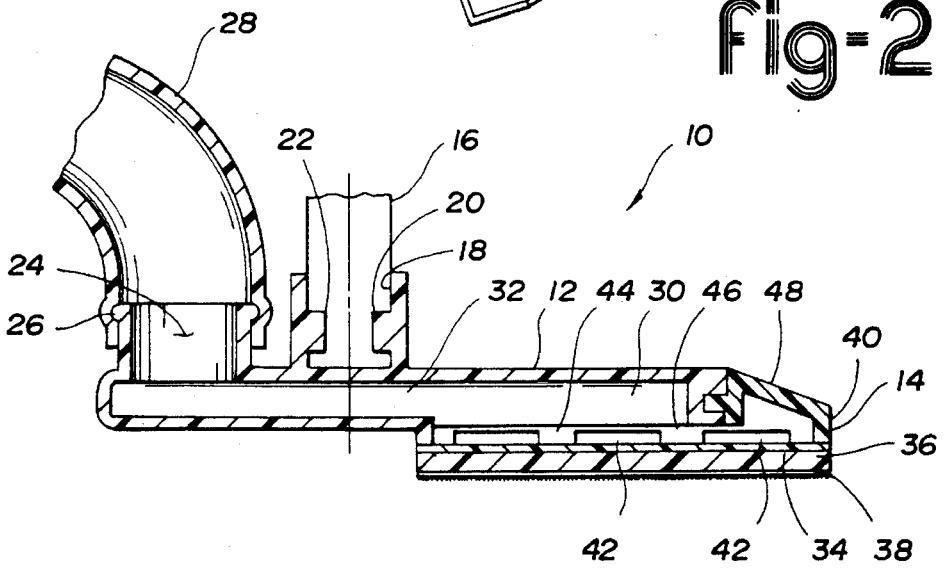
FIG. 3 is a sectional view taken along line 3—3 of FIG. 2.

As shown in FIGS. 1, 2 and 3 of the present application, one preferred embodiment of the removable working tool assembly 10 of the present invention comprises a drive member 12 and a support member 14 for an abrasive pad. Both the drive member 12 and the support member 14 may be manufactured from any suitable material, such as plastic.

As best seen in FIG. 3, the drive member 12 can be operably connected to the drive shaft 16 of the power abrasive tool (not shown), such as a finish sander. This connection between the drive member 12 and the drive shaft 16 may be permanent or disengagable as long as any oscillation, rotation or other movement of the drive shaft 16 is transmitted to the drive member 12. In the embodiment shown, the connection is of a permanent nature. The drive member 12 is formed in two symmetrical halves as a clam shell construction. The drive member has a drive shaft bore 18 which defines an inside diameter annular ring 20 which, when the two symmetrical halves as of the drive member 12 are joined together, engages a corresponding keyway 22 formed into the drive shaft 16. In order to help ensure a stable connection, the cross section of the drive shaft 16 and the drive shaft bore 18 of the drive member 12 may be correspondingly non-circular, as shown in FIGS. 1 and 2.

As shown in FIGS. 1, 2 and 3, the drive member 12 defines a drive member exit opening 24 which can be operably connected to a dust collection system which would include a vacuum apparatus (not shown) and dust receptacle or filter (now shown). Because such dust collection systems are generally well-known in the art, no further description will be provided here.

In the embodiment shown, the drive member exit opening 24 comprises a vertical hollow cylinder which has a lip 26 in order to engage the corresponding lip of a flexible suction hose 28 which forms part of the dust collection system. As best seen in FIGS. 2 and 3, the drive member 12 also defines a drive member collection opening 30 and a drive member conduit 32 which communicably connects the drive member collection opening 30 to the drive member exit opening 24.

As shown in FIGS. 1 and 3, the support member 14 has a tool surface 34 which in this embodiment is for supporting an abrasive work piece such as a sheet of sandpaper or the like. This tool surface 34 could alternatively comprise an abrasive surface itself. However, in this embodiment, the tool surface 34 is intended to support an elastomeric pad 36, which is permanently affixed to the tool surface 34, and a work member 38, such as a sandpaper pad or other abrasive material, which can be removably attached to the elastomeric pad 36 by a thin layer of adhesive. The elastomeric pad 36, which can be made from any number of rubber-like polymers, can be attached to the tool surface 34 using conventional adhesives, allows the sandpaper pad or other abrasive material to conform to the surface being abraded.

As shown in FIGS. 1 and 3, the support member 14 has a periphery surface 40 which defines dust intake openings 42. The support member 14 also defines a support exit opening 44 and support conduits 46 which connect the dust intake openings 42 to the support exit opening 44. The support member 14 can be manufactured as a clam shell construction, the tool surface 34 comprising the bottom half while the top half would comprise the upper surface 48 of the support member 14 in conjunction with the appendages defining the dust intake openings 42 and support conduits 46.

One of the drive member 12 or support member 14 also defines a male connection mechanism while the other one of the drive member 12 or support member 14 defines a female connection mechanism. As shown in FIGS. 1 and 3, in the embodiment shown the drive member 12 defines a male connection mechanism shown generally at 50 while the support member 14 defines the female connection mechanism shown generally at 52. In the embodiment shown, the male connection mechanism 50 comprises a grooved portion 54 of the drive member 12 while the female connection mechanism 52 comprises a slot 56 having a tongue 58.

In order to connect the drive member 12 to the support member 14, the grooved portion 54 is slid into the slot 56 to engage the tongue 58 such that the support exit opening 44 operably communicates with the drive member collection opening 30.

In order to prevent the male connection mechanism 50 from being easily or accidentally dislodged or disengaged from the female connection mechanism 52 during use, it may be desirable to use mating raised portions and depressions. For example, as shown in FIG. 1, the grooved portion 54 has a raised portion 60 designed to mate with the depression 62 formed into the tongue 58 of the female connection mechanism 52 of the support member 14.

During operation, any movements from the drive shaft 16 are transmitted through the drive member 12 to the support member 14 such that the work member 38 may be used to abrade the surface being worked upon. The dust collection system, if used concurrently, creates a vacuum such that dust particles exposed adjacent the periphery surface 40 are sucked sequentially through the dust intake openings 42, the support conduits 46, the support exit opening 44, the drive member collection opening 30, the drive member conduit 32, and the drive member exit opening 24 and into the flexible suction hose 28 of the dust collection system.

In the arrangements described, the support member 14 can be easily disengaged from the drive member 12 by simply sliding the male connection mechanism 50 out from the female connection mechanism 52. This feature enables alternative abrasive work members 38 to easily be substituted by a user without the use of tools.

Figure 4:
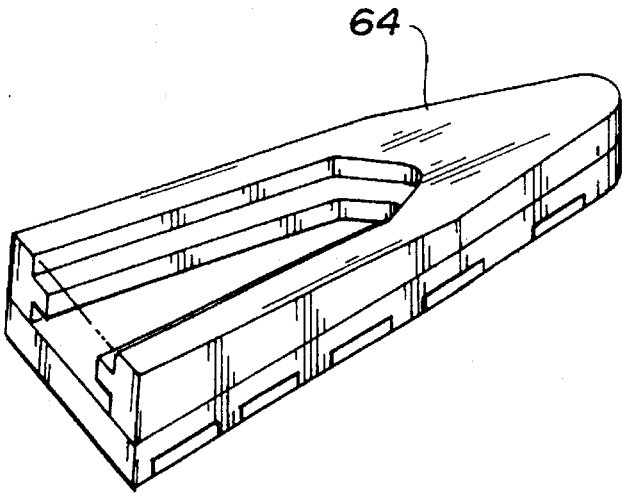
FIG. 4 is a perspective view of a second embodiment of a support member.

An alternative support member 64 is shown in FIG. 4. This embodiment is operably identical to the support member 14 shown in FIG. 1 with the exception that the peripheral geometry is changed such that the tool may be used in narrow crevices or other special applications.

Figure 5:
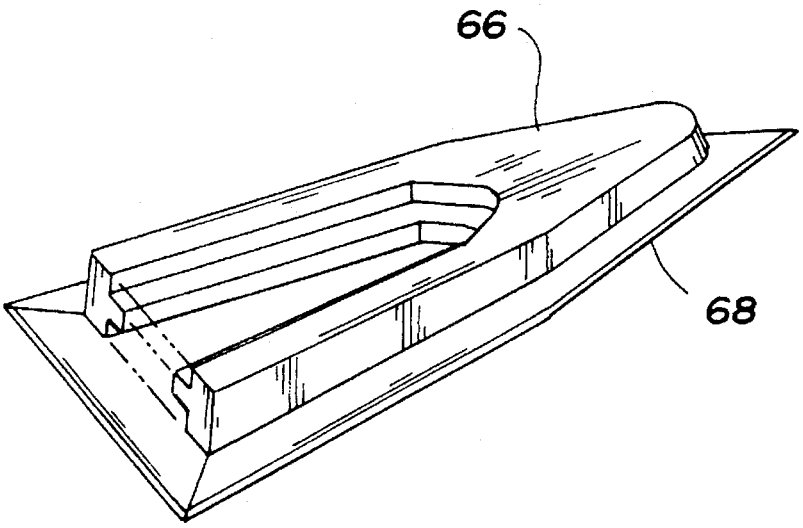
FIG. 5 is a perspective view of a third embodiment of a support member having a scraper blade.

Another alternative support member 66 is shown in FIG. 5. This embodiment is also operably similar to the support member 14 shown in FIG. 1 with the exception that the tool surface comprises a scraping tool having sharpened scraping edges 68 to be used for scraping material, such as paint, off of a work surface.

As is readily apparent, an infinite variety of such support members are possible depending upon the type of work being performed and the particular geometrical configuration desired. While the best mode for carrying out the invention has been described in detail, those familiar to the art to which this invention relates will recognize various alternative designs and embodiments for practicing the invention as defined by the following claims.

What is claimed is:

1. A removable working tool assembly to be used with a power driven tool having a drive shaft, the removable working tool assembly comprising:

a drive member which can be operably connected to the drive shaft of the power tool; and a support member having a tool surface; and one of the drive and support members defining a male connection mechanism and the other one of the drive and support members defining a female connection mechanism such that the male connection mechanism may operably engage the female connection mechanism without the need for tools or any other fastener elements, allowing the support member to be easily disconnected and reconnected to the drive member;

wherein one of the male and female connection mechanisms has a raised portion and the other one of the male and female connection mechanisms has a depression such that the raised portion and the depression engage when the male connection mechanism engages the female connection mechanism thereby preventing the male connection mechanism from being disengaged from the female connection mechanism during use.

2. The tool assembly of claim 1 wherein the drive shaft of the power tool has a center axis which, if extended after the drive member has been operably connected to the drive shaft and the support member has been operably connected to the drive member, does not intersect the tool surface of the support member.

3. The tool assembly of claim 1 wherein the tool surface of the support member comprises an abrasive material.

4. The tool assembly of claim 1 wherein the drive member extends laterally outward from the drive shaft after being operably connected to the drive shaft such that the engagement between the male connection mechanism and the female connection mechanism is spaced apart from the drive shaft.

5. The tool assembly of claim 1 wherein the tool surface of the support member defines a scraping tool.

6. A removable working tool assembly to be used with a power driven tool having a drive shaft, the removable working tool assembly comprising:

a drive member which can be operably connected to the drive shaft of the power tool; and a support member having a tool surface; and one of the drive and support members defining a male connection mechanism and the other one of the drive and support members defining a female connection mechanism such that the male connection mechanism may operably engage the female connection mechanism without the need for tools or any other fastener elements, allowing the support member to be easily disconnected and reconnected to the drive member;

wherein the drive shaft of the power tool has a center axis which, if extended after the drive member has been operably connected to the drive shaft and the support member has been operably connected to the drive member, does not intersect the central region of the tool surface of the support member.

7. The tool assembly of claim 6 wherein the male connection mechanism comprises a grooved portion and the female connection mechanism comprises a slot having a tongue such that the grooved portion may be slid into operable engagement with the slot having a tongue.

8. The tool assembly of claim 6 further comprising an elastomeric pad attached to the tool surface of the support member and an abrasive work member which can be attached to the elastomeric pad.

9. A removable working tool assembly to be used with a power tool having a drive shaft, the removable working tool assembly comprising:

a drive member having a drive end operably connected to the drive shaft of the power tool and a first connection end spaced apart from the drive shaft of the power abrasive tool;

a support member having a tool surface and a second connection end; and one of the first and second connection ends defining a male connection mechanism and the other one of the first and second connection ends defining a female connection mechanism such that the male connection mechanism may operably engage the female connection mechanism without the need for tools or any other fastener elements, allowing the support member to be easily disconnected and reconnected to the drive member.

10. The tool assembly of claim 9 wherein the male connection mechanism comprises a grooved portion and the female connection mechanism comprises a slot having a tongue such that the grooved portion may be slid into operable engagement with the slot having a tongue.

11. The tool assembly of claim 10 wherein one of the male and female connection mechanisms has a raised portion and the other one of the male and female connection mechanisms has a depression such that the raised portion and the depression engage when the male connection mechanism engages the female connection mechanism thereby preventing the male connection mechanism from being accidentally disengaged from the female connection mechanism during use.

12. The tool assembly of claim 9 wherein the drive shaft of the power tool has a center axis which, if extended after the drive member has been operably connected to the drive shaft and the support member has been operably connected to the drive member, does not intersect the central region of the tool surface of the support member.

13. The tool assembly of claim 9 wherein the drive shaft of the power tool has a center axis which, if extended after the drive member has been operably connected to the drive shaft and the support member has been operably connected to the drive member, does not intersect the tool surface of the support member.

14. The tool assembly of claim 9 wherein the tool surface of the support member comprises an abrasive material.

15. The tool assembly of claim 9 further comprising an elastomeric pad attached to the tool surface of the support member and an abrasive work member which can be attached to the elastomeric pad.

16. A removable working tool assembly to be used with a power tool having a drive shaft and a dust collection system, the removable working tool assembly comprising:

a drive member which can be operably connected to the drive shaft of the power tool and which defines a drive member exit opening which may be operably connected to the dust collection system, a drive member collection opening, and a drive member conduit connecting the drive member collection opening to the drive member exit opening;

a support member having a tool surface and a periphery surface which defines dust intake openings, the support member further defining a support exit opening and support conduits connecting the dust intake openings to the support exit opening; and one of the drive and support members defining a male connection mechanism and the other one of the drive and support members defining a female connection mechanism such that the male connection mechanism may operably engage the female connection mechanism without the need for tools or any other fastener elements with the result being that the support exit opening communicates with the drive member collection opening and which allows the support member to be easily disconnected and reconnected to the drive member;

wherein the drive shaft of the power tool has a center axis which, if extended after the drive member has been operably connected to the drive shaft and the support member has been operably connected to the drive member, does not intersect the central region of the tool surface of the support member.

17. The tool assembly of claim 16 wherein the male connection mechanism comprises a grooved portion and the female connection mechanism comprises a slot having a tongue such that the grooved portion may be slid into operable engagement with the slot having a tongue.

18. The tool assembly of claim 17 wherein one of the male and female connection mechanisms has a raised portion and the other one of the male and female connection mechanisms has a depression such that the raised portion and the depression engage when the male connection mechanism engages the female connection mechanism thereby preventing the male connection mechanism from being accidentally disengaged from the female connection mechanism during use.

19. The tool assembly of claim 16 wherein the drive shaft center axis does not intersect the tool surface of the support member.

20. The tool assembly of claim 16 wherein the tool surface of the support member comprises an abrasive material.

21. The tool assembly of claim 16 further comprising an elastomeric pad attached to the tool surface of the support member and an abrasive work member which can be attached to the elastomeric pad.

22. The tool assembly of claim 16 wherein the tool surface of the support member defines a scraping tool.

23. A removable working tool assembly to be used with a power tool having a drive shaft and a dust collection system, the removable working tool assembly comprising:

a drive member which can be operably connected to the drive shaft of the power tool and which defines a drive member exit opening which may be operably connected to the dust collection system, a drive member collection opening, and a drive member conduit connecting the drive member collection opening to the drive member exit opening;

a support member having a tool surface and a periphery surface which defines dust intake openings, the support member further defining a support exit opening and support conduits connecting the dust intake openings to the support exit opening;

one of the drive and support members defining a male connection mechanism and the other one of the drive and support members defining a female connection mechanism such that the male connection mechanism may operably engage the female connection mechanism without the need for tools or any other fastener elements with the result being that the support exit opening communicates with the drive member collection opening and which allows the support member to be easily disconnected and reconnected to the drive member; and wherein the drive member extends laterally outward from the drive shaft after being operably connected to the drive shaft such that the engagement between the male connection mechanism and the female connection mechanism is spaced apart from the drive shaft.

* * * * *